US006321395B1

(12) United States Patent
Parsons et al.

(10) Patent No.: US 6,321,395 B1
(45) Date of Patent: Nov. 27, 2001

(54) TIMED FLUID-LINKED FLUSH CONTROLLER

(75) Inventors: Natan E. Parsons, Brookline; Fatih Guler, Winchester, both of MA (US)

(73) Assignee: Arichell Technologies, Inc., West Newton, MA (US)

( * ) Notice: Subject to any disclaimer, the term of this patent is extended or adjusted under 35 U.S.C. 154(b) by 0 days.

(21) Appl. No.: 09/716,870

(22) Filed: Nov. 20, 2000

(51) Int. Cl.[7] ..... E03D 1/34
(52) U.S. Cl. ..... 4/378; 4/367; 251/29
(58) Field of Search ..... 4/366, 367, 378, 4/354; 251/29

(56) References Cited

U.S. PATENT DOCUMENTS

| | | | | |
|---|---|---|---|---|
| 2,760,204 | * | 8/1956 | Joanis | 4/367 |
| 2,858,546 | | 11/1958 | Tekenos . | |
| 3,817,279 | | 6/1974 | Larson | 137/572 |
| 3,817,489 | | 6/1974 | Caron et al. | 251/38 |
| 3,820,171 | | 6/1974 | Larson | 4/31 |
| 3,820,754 | | 6/1974 | Caron et al. | 251/38 |
| 4,034,423 | | 7/1977 | Milnes | 4/41 |
| 4,141,091 | | 2/1979 | Pulvari | 4/313 |
| 4,193,145 | | 3/1980 | Gross et al. | 4/346 |
| 4,233,698 | | 11/1980 | Martin | 4/354 |
| 4,304,015 | | 12/1981 | Hubatka | 4/407 |
| 4,357,720 | | 11/1982 | Stahli | 4/378 |
| 4,575,880 | | 3/1986 | Burgess | 4/313 |
| 4,662,395 | | 5/1987 | Strangfeld | 137/614.19 |
| 4,756,031 | | 7/1988 | Barrett | 4/407 |
| 4,941,215 | | 7/1990 | Liu | 4/406 |
| 5,003,643 | | 4/1991 | Chung | 4/313 |
| 5,005,226 | * | 4/1991 | Basile et al. | 4/354 |
| 5,187,818 | | 2/1993 | Barrett, Sr. et al. | 4/313 |
| 5,313,673 | | 5/1994 | Saadi et al. | 4/313 |
| 5,335,694 | | 8/1994 | Whiteside | 137/625.37 |
| 5,341,839 | | 8/1994 | Kobayashi et al. | 137/505.13 |
| 5,361,426 | | 11/1994 | Martin | 4/361 |
| 5,400,446 | | 3/1995 | Bloemer et al. | 4/408 |
| 5,431,181 | | 7/1995 | Saadi et al. | 31/40 |
| 5,603,127 | | 2/1997 | Veal | 4/246.1 |
| 5,649,686 | | 7/1997 | Wilson | 251/40 |
| 5,652,970 | | 8/1997 | Wodeslavsky | 4/378 |
| 5,884,667 | | 3/1999 | North | 138/43 |
| 6,263,519 | * | 7/2001 | Parsons et al. | 4/378 X |

FOREIGN PATENT DOCUMENTS

| | | |
|---|---|---|
| 312750B1 | 4/1989 | (EP) . |
| 0828103 A1 | 3/1998 | (EP) . |
| 1332995 | 10/1973 | (GB) . |
| 2277108A | 10/1994 | (GB) . |
| 2277750A | 11/1994 | (GB) . |
| 2329452A | 3/1999 | (GB) . |
| 98/06910 | 2/1998 | (WO) . |
| 98/10209 | 3/1998 | (WO) . |

* cited by examiner

*Primary Examiner*—Charles E. Phillips
(74) *Attorney, Agent, or Firm*—Cesari and McKenna, LLP

(57) ABSTRACT

By depressing a push button (42), a toilet user opens a valve (44) that permits pressure holding a flush valve (12) seated to be exhausted through a pressure-relief line (48). The pressure in the flow path by which liquid thereby leaves the outlet (46) of the remote valve (44) tends to hold that remote valve's valve member (100) open after the user releases the push button (42). But pressure from the pressure-relief line (48) slowly builds up in a seating-pressure chamber (110) by fluid flow through a high-flow-resistance path provided by a passage containing a fluted pin (114). After a resultant delay sufficient to permit the toilet's tank (16) to empty through the outlet (22) controlled by the flush valve (12), the pressure within the seating-pressure chamber (80) reaches a point at which the force exerted by it on the valve member (110) exceeds the flow-path-pressure force tending to keep that valve member unseated. The remote valve (44) therefore closes and as a result causes the flush valve to close.

6 Claims, 5 Drawing Sheets

TIMED FLUID-LINKED FLUSH CONTROLLER

BACKGROUND OF THE INVENTION

1. Field of the Invention

The present invention is directed to toilet flushing. It finds particular, although not exclusive, application in tank-type flushers.

2. Background Information

Toilet flushers come in a wide arrange of designs. (We use the term toilet here in its broad sense, which encompasses what are variously referred to as toilets, water closets, urinals, etc.) Many designs are of the gravity type, which uses the pressure that results from the weight of water stored in a tank to flush the bowl and provide the siphoning action by which the bowl's contents are drawn from it. Any flusher of this type employs a main flush valve, which controls the release of water from the tank through the tank outlet that leads to the bowl. For the flusher to act effectively, that flush valve must remain open long enough to let the required amount of water flow from it into the bowl.

If A popular way of achieving the proper flush-valve-opening duration is to employ a pivoting flush valve on which a timer cup is disposed. The valve is pivoted to unseat it, and water in the full flush tank fills the timer cup. This so weights the cup that it keeps the valve pivoted to the open position. An orifice in the timer cup allows water to leak from it when the tank level has fallen below that of the timer cup. After a length of time great enough to allow most of the liquid to drain from the timer cup, the flush valve then pivots back into its closed position.

Another popular approach, typically used in automatic toilets, is to use a timer circuit to time activation of a solenoid that controls the flush valve's operation. An advantage of many such installations is that they use line pressure to operate the flush valve and can therefore be arranged so that the flush valve seals more effectively than the typical manual flusher's.

SUMMARY OF THE INVENTION

We have devised an approach to flush-duration control that does not require electrical timing circuitry and yet lends its self to more-effective flush-valve operation than most manually operated flush valves customarily afford. This approach employs a valve-operating mechanism of the type in which water-line pressure is admitted into a control chamber whose resultant pressure can be relieved through a control-chamber pressure-relief outlet. The flush valve seals very effectively because pressure in a control chamber holds the flush valve seated when the line pressure prevails in it. When that pressure is relieved, the valve-operating mechanism opens the flush valve.

According to the invention, that pressure is relieved by a pressure-relief valve disposed at a remote location and interposed in a pressure-relief conduit that extends from the control chamber's pressure-relief outlet to the remote location. When the remote valve is closed, it prevents flow through the pressure-relief conduit and thereby prevents pressure relief in the control chamber. It is operable by manual depression from the closed state to an open state, in which it permits such flow and therefore relieves pressure within the control chamber. The flush valve is kept open for a relatively fixed duration because the remote valve is of a type that mechanically imposes a time delay between the user's releasing the valve's operation and the remote valve's closing.

In one embodiment, for instance, the remote valve is similar to time-delay valves often used in public-washroom faucets. The remote valve's valve member is exposed to the pressure in the flow path that the valve controls, and that pressure exerts a force that tends to keep the valve member unseated. A countervailing force results from the pressure that prevails in a seating-pressure chamber, and the effective area over which that pressure is exerted on the valve member is such that, if the pressure within the seating-pressure chamber equals the flow-path pressure, the resultant force exceeds the force resulting from exposure to the flow path, and the valve is held in its close state. A bleed path from the remote valve's inlet leads to the seating-pressure chamber.

The seating-pressure chamber's volume is greater when the valve is seated than when it is not, and the liquid needed to fill the additional volume when the valve moves from its unseated to its seated positions flows through the bleed path. But the flow resistance presented by the feed path delays the remote-valve member's seating-and thereby the flush valve's closing-for a time long enough that the requisite liquid can flow from the tank through the flush valve. This delay will always exceed two seconds, but the particular delay depends on factors such as tank size and valve configuration.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
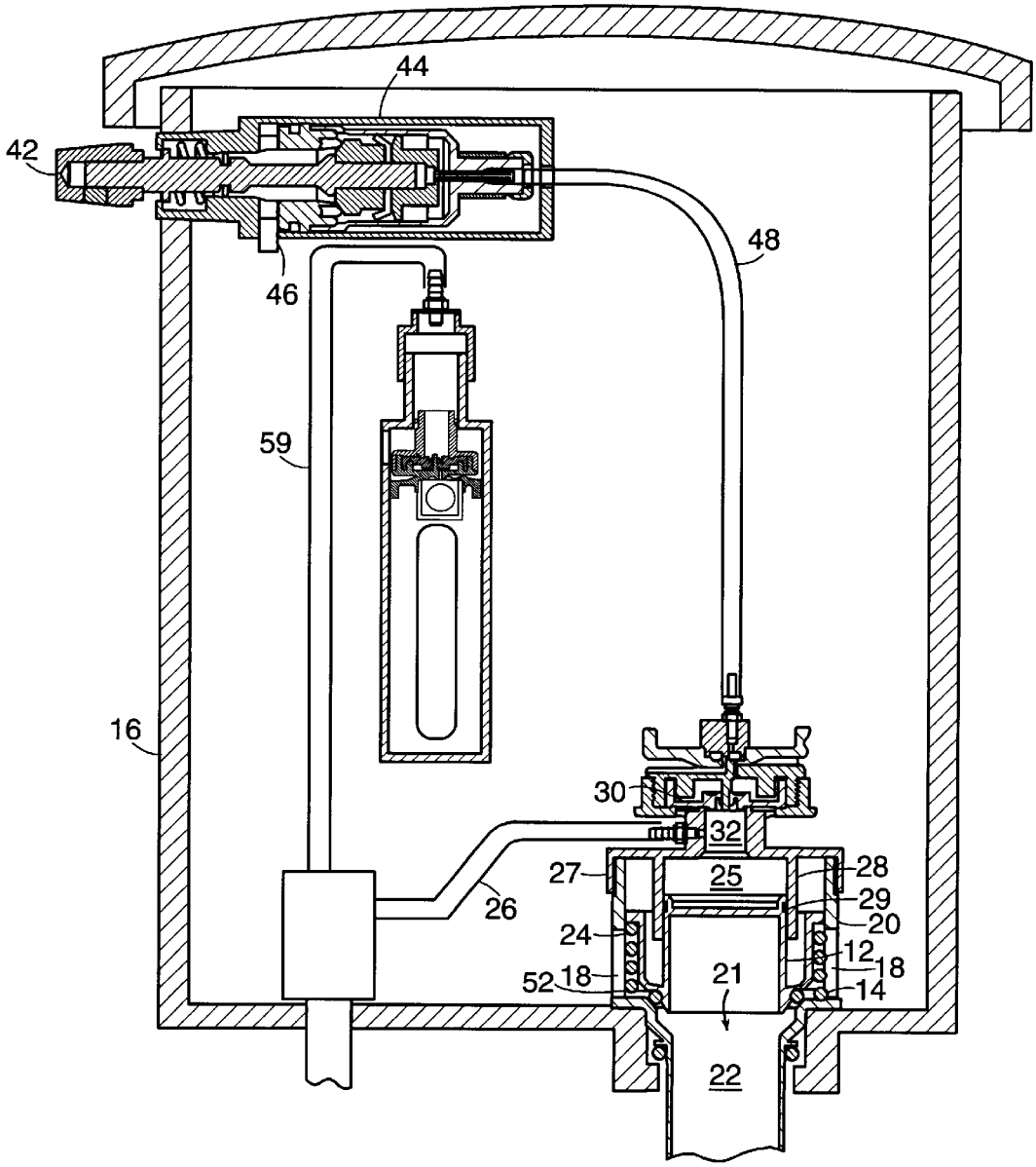
FIG. 1 is a sectional view of a toilet tank illustrating its float and gravity-type flush valves.

In the state that FIG. 1 depicts, a gravity-type flush mechanism's flush-valve member 12 is seated in a flush-valve seat 14 formed in the bottom of a toilet tank 16. In that seated position, the valve member 12 prevents water in the tank 16 that has entered through flush ports 18 in a flush-valve housing 20 from flowing through a flush outlet 21 and a flush conduit 22 to a toilet.

Figure 2:
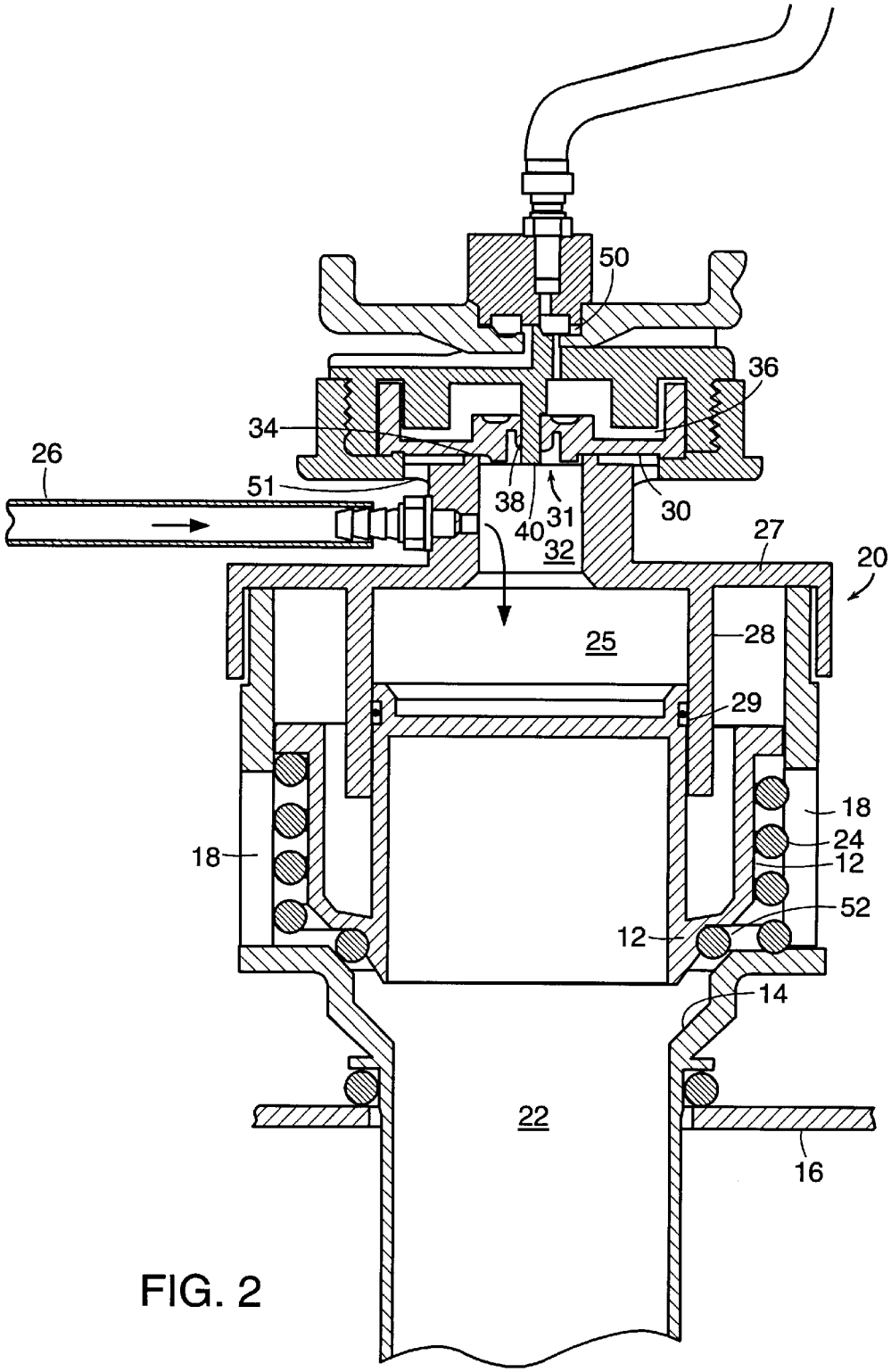
FIG. 2 is a more-detailed cross section of the gravity-flush valve in its closed state.

As FIG. 2 shows, the flush mechanism includes a bias spring 24. The bias spring exerts a force that tends to urge the flush-valve member 12 off its seat 14. But pressure that normally prevails in a chamber 25 because of its communication with a (pressurized-) water source conduit 26 keeps the flush-valve member seated between flushes. The flush-valve housing 20's cap 27 provides this chamber, and the flush-valve member is slideable within a cylinder 28 that the cap forms.

The valve member's seal ring 29 cooperates with a pilot-valve diaphragm 30 to prevent escape of the pressurized water from the piston chamber 25 through a pressure-relief outlet 31 in chamber 25's narrowed passage portion 32. The pilot-valve diaphragm 30 is resiliently deformable, so the pressure that prevails within passage 32 would tend to lift it from engagement with the pilot-valve seat 34 if a similar pressure did not prevail within pilot chamber 36 and act on the diaphragm 30 over a greater area. The reason why this pressure prevails within chamber 36 is that a small orifice 38 through which a pilot-valve pin 40 extends permits water to bleed into it (through a relatively high flow resistance).

Figure 3:
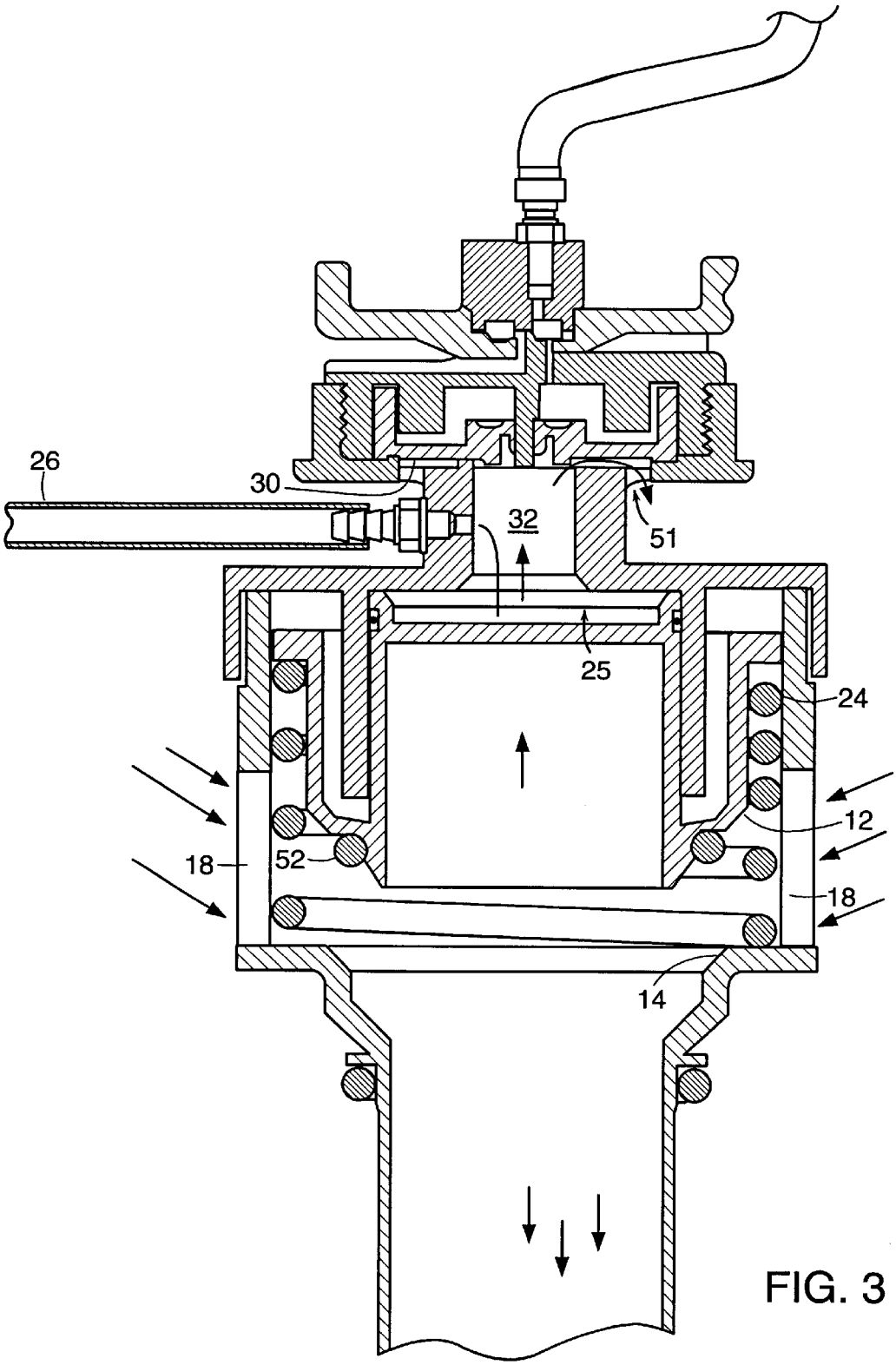
FIG. 3 is a similar view of the gravity-type flush valve, but in its open state.

To cause the system to flush, the user depresses FIG. 1's push button 42. As will be explained in more detail below, this causes a remote pressure-relief valve 44 to permit flow to its outlet 46 from a pressure-relief tube 48 that communicates with FIG. 2's chamber 36 through passages 50. This relieves pressure in that chamber. The flow resistance through that path is much lower than the bleed orifice 38's flow resistance, so the pressure within chamber 36 drops and permits that within passage 32 to raise diaphragm 30 off its seat, as FIG. 3 shows. The diaphram thus serves as a pressure-relief valve. Specifically, it permits the pressure within passage 32 and thus within chamber 25 to be relieved through a plurality of openings such as opening 51. As a consequence, the bias spring 24 can overcome the force exerted by the pressure within chamber 25. The flush-valve member 12 shown in FIG. 1 therefore rises, lifting its O-ring seal 52 off the main valve seat 14 and thereby allowing the tank to empty.

Figure 4:
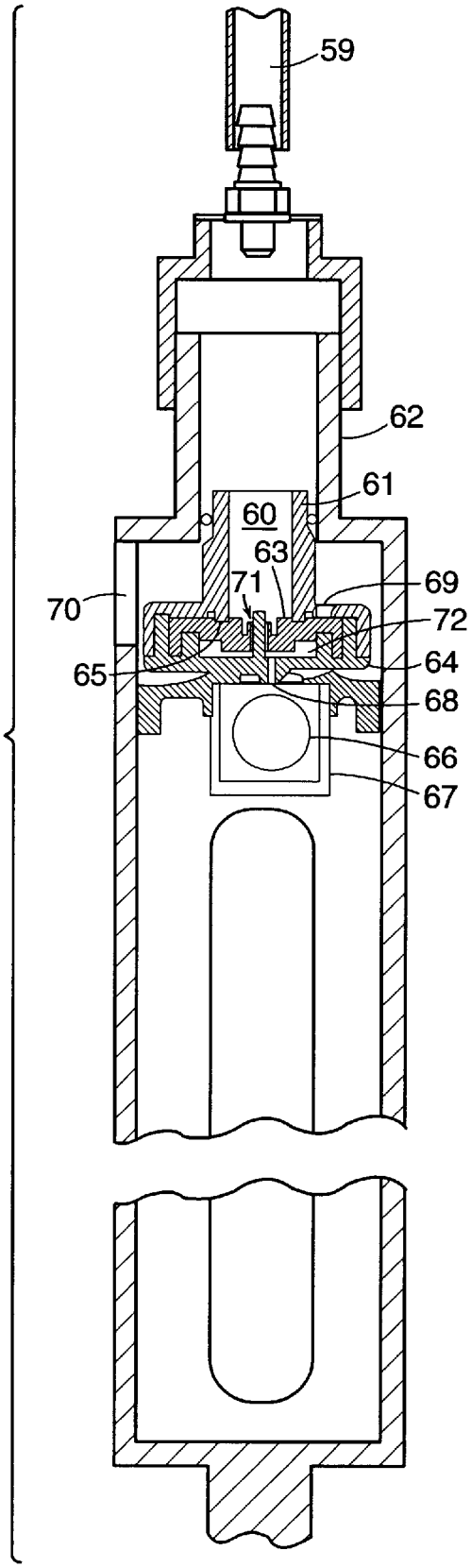
FIG. 4 is a cross-sectional view depicting FIG. 1's float valve in more detail.

After the tank thus empties, the remote valve closes, as will be explained below in more detail, to prevent any further flow out of chamber 36. The pressure above diaphragm 30 can therefore again build to equal that below it, so diaphragm 30 again seats to cause pressure in chamber 25 to produce enough force to close the main flush valve 12 again. As a result, flow from FIG. 1's main line 59 fills the tank through a float-valve assembly best seen in FIG. 4. Specifically, water from line 59 flows through a main valve passage 60 formed by a valve cap 61 sealingly secured in a float-valve frame 62. A diaphragm 63 is held between the valve cap 61 and a valve plug 64 threadedly secured to the valve cap 61 and also sealed to the float-valve frame 62.

At rest, the resilient diaphragm 63 seats against a valve seat 65 that the valve cap 61 forms. So long as a ball float 66 disposed in a float cage 67 provided by the valve plug 64 does not plug a pressure-relief orifice 68, though, the pressure within passage 60 causes such a deformation of the resilient diaphragm 63 as to leave a clearance between it and the valve seat 65. So water from passage 60 can flow around the valve seat 65 through a valve-cap opening 69 and openings 70 in the float-valve frame 62.

The rising water in the tank eventually lifts the float 66 into a position in which it blocks the pressure-relief orifice 68. This prevents the escape of water that has bled through a high-flow-resistance orifice 71 into a chamber 72 that the diaphragm 63 forms with the valve plug 64. So the pressure within that chamber approaches that within the passage 60. Moreover, that pressure acts on the diaphragm 63's lower surface over a greater area than the same pressure does on the diaphragm's upper surface. The resultant upward force presses the diaphragm 63 against its seat 65 and prevents further flow from the high-pressure line 59 into the tank. In the illustrated embodiment, the water level at which this occurs can be adjusted by adjusting the height within the frame 62 of the cap 61, plug 64, and parts connected to them.

Figure 5:
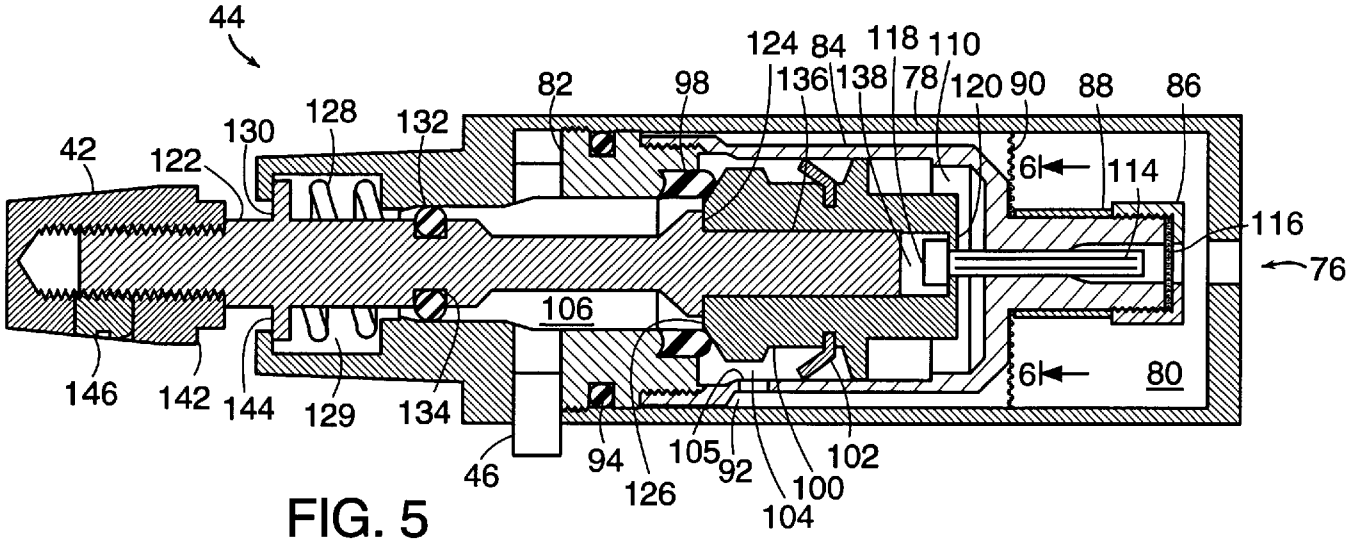
FIG. 5 is a cross-sectional view of the push-button valve of FIG. 1.

We now turn to FIG. 5 to discuss in more detail the remote valve 44's operation. The relief tube 48 (not shown in FIG. 5) terminates in the inlet 76 of the relief valve 44's housing 78. It thereby communicates with a main-valve entrance chamber 80. Cooperating threads on a seal frame 82 and a valve core 84 secure the latter to the former, which in turn is threadedly secured to the housing 78's interior. A nut 86 threadedly secured to the end of the valve core 84 bears against a washer 88 that holds a screen 90 in place. By flowing through the screen, water from the entrance chamber 80 can enter an annular space 92 sealed by an O-ring 94 that the seal frame 82 holds in place against the housing 78's inner surface.

A lip seal 98 mounted on the seal frame 82 acts as a valve seat. In the illustrated, closed valve state a movable valve member 100 seats against that lip seal. When the valve is thus closed, a second lip seal 102 mounted on the valve member 100 cooperates with lip seal 98 to prevent water from flowing from an outlet-passage entrance chamber 104, with which a core port 105 provides annular space 92 communication, through an annular outlet passage 106 and out the valve outlet port 46.

Figure 6:
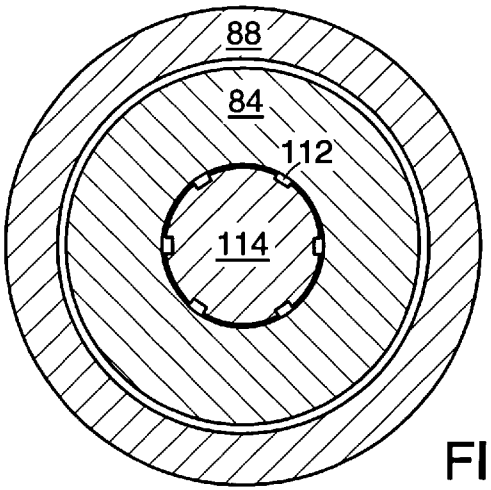
FIG. 6 is a cross-sectional view taken at line 6—6 if FIG. 5.

The resultant pressure in the outlet-passage entrance chamber 104 exerts a force against the lip seal 102 that would tend to unseat the valve member 100, but the valve member remains seated because equal pressure in another, seating-pressure chamber 110 acts over a greater area and thereby exerts a greater, countervailing force. Pressure prevails in that seating-pressure chamber because, as FIG. 6 illustrates, the valve core forms a pin passage 112 in which a fluted core pin 114 is disposed to form a high-flow-resistance flow path from the main valve entrance chamber 80 through a further screen 116 into the seating-pressure chamber 110. Acting against the core pin's enlarged head 118, an internal lip 120 retains the core pin.

The push button 42 that the user manually depresses to release the relief tube's pressure and thereby operate the flush valve is threadedly secured to an actuator rod 122 whose stop surface 124 bears against a valve-member shoulder 126 that acts as a stationary stop. To depress that button, the user overcomes the force that a bias spring 128 located in a spring recess 129 formed by the valve housing 78 exerts on a collar 130 formed by the actuator rod.

As a result, the actuator rod 122 bears against valve member 100, and the user overcomes fluid-flow resistance (explained below) and the force from the seating-pressure chamber 110 to displace the valve member 100 to the right. This both unseats the valve member from the upper lip seal 98 and drives water out of the seating-pressure chamber 110 through passage 112. By unseating the valve, the user opens communication between the outlet-passage entrance chamber 104 and the outlet passage 106. That is, pressure in the pressure-relief tube is relieved through a valve flow path that includes the main entrance chamber 80, the annular space 92, core port 105, the annular outlet passage 106, and the main valve outlet port. An O-ring seal 132 mounted in an annular seal groove 134 that the actuator rod 122 forms prevents leakage through the spring recess 129.

Now, the actuator rod's end shaft 136 is slideable within the valve member's central passage 138, so the bias spring 128 can urge that actuator-rod's stop surface 124 out of engagement with the valve member 100 when the user releases the push button 42. The user usually releases the push button while most of the water has yet to drain from the flush tank. So there should be a delay during which the remote valve 44 remains open so that the flush valve does, too. Such a delay occurs in the illustrated embodiment because the valve member 100's movement from its unseated position to its seated position increases the seating-pressure chamber's volume and thus necessitates flow into it in order to return its pressure to the value that prevails at the inlet 76 and thus in the space 104 whose pressure tends to keep the valve member 100 unseated. But the flow resistance of the passage 112 by which that make-up must flow into the seating-pressure chamber 110 is so great that this flow causes a simplified pressure drop for several seconds. As a consequence, the force on the valve member 100 caused by the pressure within the seating-pressure chamber 10 is not great enough to overcome the force from space 104's pressure, so the valve member 100 remains unseated for that length of time.

The precise duration of the delay between the user's release if the push button 42 and the valve member's seating-and thus of the flush valve's closing-depends to a great extent on the difference between the seating-pressure chamber's volumes in the two states. This in turn depends on the travel permitted by the illustrated valve-closed distance between the push button 42's stop surface 142 and the housing's end lip 144. A set screw 146 enables installation personnel to adjust that distance and thereby the length of time for which the flush valve is open.

Although the present invention's teachings can be employed in systems in which the valve member is unseated by, for instance, solenoid action, its advantages will be most apparent in systems that are manually operated. The present invention advantageously provides simple mechanical control in a way that permits the use of line pressure to seat the flush valve. It thus constitutes a significant advance in the art.

What is claimed is:

1. A flusher comprising:

A) a tank forming a flush outlet by which liquid in the tank may leave the tank for flushing;

B) a flush-valve member operable between an unseated state, in which it permits flow from the tank through the flush outlet, and a seated state, in which it prevents flow from the tank therethrough;

C) a valve-operating mechanism including a housing that defines a control chamber disposed at a local location and forms a line-pressure inlet that admits water line pressure into the control chamber and further forms a control-chamber pressure-relief outlet, by which pressure in the control chamber can be relieved, the valve-operating mechanism operating the flush-valve member to its seated state when the line pressure prevails in the control chamber and operating the flush-valve member to its unseated state when the pressure in the control chamber is relieved, the valve-operating mechanism further including:

i) a pressure-relief conduit extending from the control-chamber pressure-relief outlet to a remote location, and ii) a remote valve, disposed at the remote location, interposed in the pressure-relief conduit, and operable by depression from a closed state, in which it prevents flow through the pressure-relief conduit and thereby prevents relief of pressure within the control chamber, to an open state, in which it permits flow through the pressure-relief conduit and thereby permits relief of pressure within the control chamber, and operable by release of that depression from its open state to its closed state after a flush-time delay of at least two seconds.

2. A flusher as defined in claim 1 wherein the remote valve includes:

A) a remote-valve inlet;

B) a remote-valve outlet;

C) a remote-valve flow path between the remote-valve inlet and the remote-valve outlet;

D) a remote-valve seat interposed in the remote-valve flow path;

E) a remote-valve member operable between a seated position, in which it so seats in the remote-valve seat as to prevent flow through the remote-valve flow path, and an unseated position, in which it is so unseated from the remote-valve seat as to permit flow through the remote-valve path and is so exposed to the pressure in the remote-valve flow path as to experience an unseating force therefrom that tends to keep the valve member unseated;

F) a seating-pressure chamber partially defined by the remote-valve member in such a manner that:

i) the volume of the seating-pressure chamber is greater when the remote-valve member is seated than when the remote-valve member is unseated and thereby requires a make-up flow of fluid thereinto when the remote-valve member moves from its unseated position to its seated position; and ii) the pressure prevailing in the seating-pressure chamber exerts a seating force on the remote-valve member that tends to seat the remote-valve member and exceeds the unseating force and thereby holds the remote-valve member in its seated position when the pressure in the seating-pressure chamber equals that in the remote-valve flow path; and G) a bleed path between the remote-valve flow path and the seating-pressure chamber that so resists the make-up flow therethrough as to impose the flush-time delay.

3. A flusher as defined in claim 2 wherein the remote valve includes an actuator movable in an unseating direction from a retracted position, in which it does not keep the valve member unseated, its movement in the unseating direction causing it to bear against the remote-valve member and being limited to an adjustable stop position, in which it holds the valve member in the unseated position.

4. A flusher as defined in claim 3 wherein:

A) the actuator provides an actuator stop surface that moves with the actuator;

B) the remote valve includes a stationary housing that provides a stationary stop interposed in the path that the actuator stop takes as the actuator moves in the unseating direction and thereby stops the actuator in the stop position; and C) at least one of the actuator stop surface and the stationary stop is adjustable in position to make the stop position adjustable.

5. A flusher as defined in claim 4 wherein the actuator includes a stop member mounted in an adjustable position thereon.

6. A flusher as defined in claim 1 wherein the remote valve is operable by manual depression.

* * * * *